United States Patent [19]

Eigenmann

[11] 4,236,950

[45] Dec. 2, 1980

[54] ROAD MARKING MACHINE AND METHOD

[76] Inventor: Ludwig Eigenmann, Vacallo, Canton Ticino, Switzerland

[21] Appl. No.: 845,834

[22] Filed: Oct. 26, 1977

[30] Foreign Application Priority Data

Oct. 27, 1976 [IT] Italy ..... 28747 A/76

[51] Int. Cl.[2] ..... E01F 9/08; E01C 23/16; B32B 31/24; B05C 5/00

[52] U.S. Cl. ..... 156/71; 118/305; 118/308; 156/280; 156/281; 156/523; 156/524; 156/574; 156/575; 156/577; 239/150; 404/12; 404/14; 404/72; 404/93; 404/94; 427/136; 427/137

[58] Field of Search ..... 40/612; 118/305, 308; 156/71, 280, 281, 523, 524, 526, 574, 575, 577; 239/150; 180/1 AP; 404/12, 14, 72, 73, 93, 94; 427/136, 137

[56] References Cited

U.S. PATENT DOCUMENTS

| | | | |
|---|---|---|---|
| 3,820,718 | 6/1974 | Ammon | 239/150 X |
| 3,886,011 | 5/1975 | Eigenmann | 156/71 |
| 3,964,559 | 6/1976 | Eigenmann | 156/523 X |
| 4,030,958 | 6/1977 | Stenemann | 156/71 X |
| 4,069,281 | 1/1978 | Eigenmann | 404/14 X |
| 4,102,718 | 7/1978 | Eigenmann | 156/71 |

*Primary Examiner*—John T. Goolkasian
*Assistant Examiner*—Robert A. Dawson
*Attorney, Agent, or Firm*—Michael J. Striker

[57] ABSTRACT

A compound machine for mechanically forming traffic dividing and regulating lines on a roadway pavement, comprising a motor driven vehicle adapted to travel along a desired direction on said pavement, the machine being implemented by a first apparatus supplied and adapted for forming spaced line segment by applying on said pavement spaced lengths of a multilayer road marking prefabricated tape material, and by a second apparatus supplied and adapted for forming painted marking line lengths aligned with and in the intervals between the spaced road marking tape segments, whereby a discontinuous marking line including alternatively arranged tape segments and painted segments is formed on the roadway pavement.

14 Claims, 4 Drawing Figures

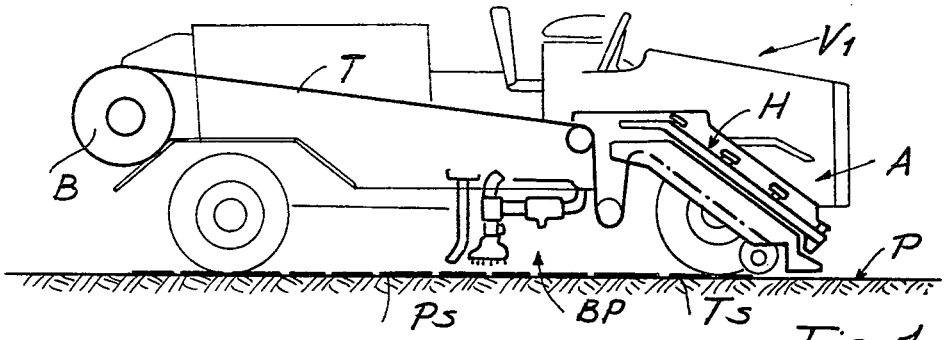
Fig. 1
Fig. 2
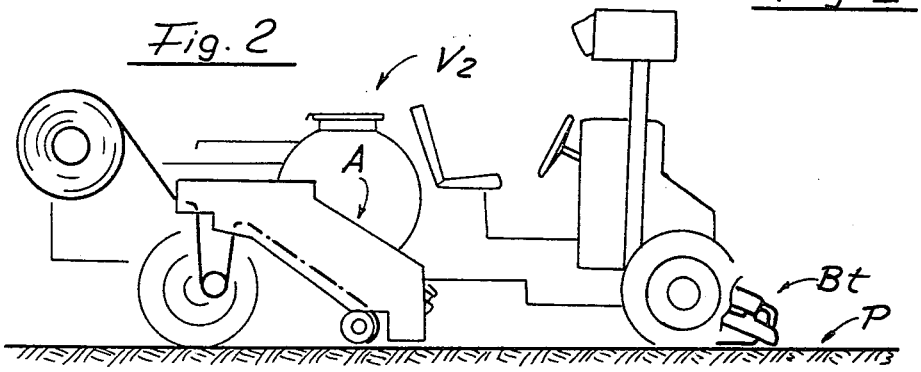
Fig. 3
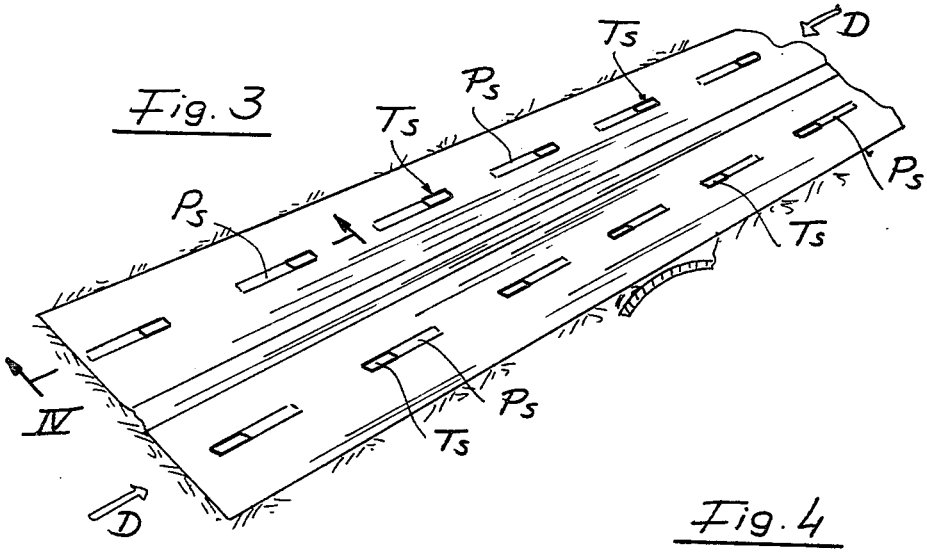
Fig. 4
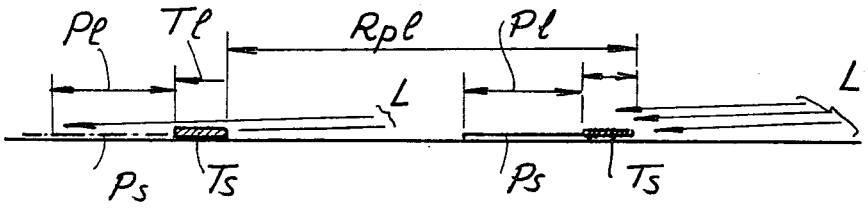

ROAD MARKING MACHINE AND METHOD

BACKGROUND OF THE INVENTION

1. Field of the Invention

This invention is concerned with the art of forming traffic dividing and regulating lines on roadway pavements, such as center or edge lines, or traffic lane dividing lines along a roadway or highway.

2. Description of the Prior Art

This art is a widely known and well worked one and a variety of machines for forming said lines, either in continuous or interrupted manner, that is by forming aligned spaced lengths of the line, as most common in traffic lane dividing lines. A large patent and technical literature exists for the art. These lines can be formed by making use of different methods.

The older but still applied method comprises forming the line by spraying paint in printed or other forms on the roadway pavement and many machines for quickly and economically performing such operation have been devised. The British Pat. Specification No. 410,094, published on 1934, might be considered a basic one in the art, which has been substantially and continuously improved. One improvement consists in spraying retro-reflective beads on the freshly applied paint for improving visibility in particular nighttime visibility to the marking line. Efficient machines for continuously or programmedly discontinuously forming marking lines, by painting, are manufactured by several manufactures and available on trade.

Another method for forming road marking lines consists of forming the line of the line lengths by applying thermoplastic substance in heat liquified or plasticized status on the road pavement and causing the same to harden thereon at the desired location and configuration. This method also is old, such as described in the U.S. Pat. No. 1,726,832, issued on Sept. 3, 1929. Consistently improved machines have been and are produced and available on the market.

Machines for forming continuous or programmedly discontinuous road marking lines on the surface of a roadway pavement are produced and sold by a plurality of manufacturers, such as for example Wilson & Scott Ltd, of Chertsey, Surrey (Breat Btitain), Hofmann Universal-Markiermaschine, of Hamburg (West Germany) and many others.

No problem therefore exists as to the availability and the operations concerned with the machines and the forming of marking lines by applying the above methods.

A third method comprises factory producing and winding into bobbins a prefabricated tape material adapted for being laid on and adhesively secured to the roadway pavement, upon a tape receiving under-layer (or "primer" layer), suitable machines being provided for forming the marking line on said pavement by progressively unwinding the tape, cutting the same into suitable long lengths, when a discontinuous line is to be formed.

This third method has been principally developed and improved by the Applicant of the application. In the U.S. Pat. No. 3,007,838 there has been a first embodiment of a tape applying and marking line forming apparatus. Subsequent U.S. Pat. Nos. 3,155,564, 3,235,436, 3,844,669, 3,886,011, 3,964,559 and 3,964,835 have described and shown many omprovements and details of such machines, including mechanisms for progressing and cutting the tape material, for pressuredly applying it on the roadway pavement, more particularly on an under-layer and for preliminarily forming said under-layer or primer layer on the road surface.

Concurrently with the development and improvement of the machines and the operations for applying the tape material to the road surface, said tape materials have been developed and successively improved, either as to their properties of being firmly and durably secured to the road surface, and as to their properties of ensuring the best nighttime visibility, under the illumination provided by the "grazing" light emitted by the head lamps of the travelling cars and vehicles, this visibility being evidently essential for traffic safety.

The art most principally related to the road marking tape material has been principally described in the following U.S. Pat. Nos. 3,262,375, 3,399,607, 3,587,415, 3,782,843, 3,879,148, 3,958,891 and 4,020,211. A number of composition adapted for forming the tape materials, the elements secured to the upper face of the tape for light impingement and reflection and so on, have been described.

Generally, the primer layer is formed and caused to at least partially set on the road surface and then the tape material is laid thereon. A new approach for further improving this art has been described and made open to public in the published German Patent Application P 27 02 442.6 and in the French Patent Publication No. 77.04466 of the present applicant. (U.S. Pat. No. 4,102,718).

According to this recent proposal, a composite tape material is provided including juxtaposed layers, more particularly an upper layer (assuming that the multilayer has been applied) comprising all components and elements as necessary for providing traffic wear resistance, and principally daytime and nighttime visibility, and at least a lower layer adapted to from the under-layer or primer layer for the road marking tape material.

THE OBJECTS OF THE INVENTION

Considering now the entire above road marking art, it is to be taken into consideration that the first and the second methods, and principally the first one (forming the line by paint) are the most economical and provide a quick marking formation, in term of the speed at which the machine can travel along the road to be marked and forming the line. The third method (forming the line by applying a prefabricated tape material) provided the highest quality of the marking, principally as the nighttime visibility is concerned, but the tape material is rather costly, in particular if and when provided with highly efficient and sophisticated retroreflective elements for ensuring the best and most safe light retroreflection at distance, where the light rays form an extremely small angle with the horizontal, namely the plane generally defined by the roadway surface. Further, the speed at which a such marking tape applying machine, if of simple type, can travel along the road to be marked, is undesirably low. This low speed is generally caused by the fact that the primer layer requires a substantial time for being set at the most convenient viscous state for application and intimate adhesion to the road pavement.

SUMMARY OF THE INVENTION

According to the invention, there is provided a structurally and operatively unitary machine comprising a motor-driven vehicle adapted to travel along a roadway in a direction concurrent with the marking line to be formed, a marking tape applying apparatus arranged for applying and securing on the roadway pavement spaced lengths of prefabricated tape material of the primer layer including multilayer type, to form highly retroreflective segments of a road marking line, said segments being spaced from each other, and a line marker apparatus arranged and positioned on said vehicle for forming by applying an essentially liquid substance, segments of a marking line, aligned with and at least in part of the spacings between the said reflective segments.

Preferably, the line marker apparatus comprises means for forming painted line segments.

It has been surprisingly found that marking line, such as a traffic lane dividing line, consisting of alternately arranged aligned painted segments and highly reflective segments, is visible and reflective, at distance (that is where the retroreflectivity is essential) not noticeably less than a marking line completely formed by a road marking tape material, while the amount of tape material, actually comprised in the line, is greatly less (say from one third to one fifth, for example) than that necessary for spanning the entire length of the thus formed composite segments.

These and other objects and advantages of the invention will be made apparent as this description proceeds with reference to the accompanying drawings, wherein embodiments of the machine are illustrated in a purely diagrammatical manner in consideration of the fact that the vehicle and the apparatuses, as individually considered, can be arranged and operated by applying the known art, in particular as widely and detailebly and taught in the above indicated patent literature.

THE VIEWS OF THE DRAWINGS

FIG. 1 a diagrammatical side view of a first embodiment of the invention, comprising an apparatus for sequentially and spacedly applying on the road pavement segments of prefabricated multilayer tape material, in combinations with an apparatus for painting line segments;

FIG. 2 is a similar side view of a modified embodiment of the invention, wherein a prefabricated tape material applying apparatus as above is combined with a known apparatus for forming line segments by spraying a thermoplastic composition on the road pavement;

FIG. 3 is a diagrammatival perspective view of a part of a highway provided with traffic lane dividing lines formed by marking use of a machine according to FIG. 1 or to FIG. 2; and FIG. 4 is a diagrammatical longitudinal vertical sectional view of a portion of one of said dividing line, taken along IV—IV of FIG. 3.

DESCRIPTION OF THE PREFERRED EMBODIMENTS

The machine of FIG. 1 or of FIG. 2 comprises a vehicle $V_1$ or respectively $V_2$ adapted for carrying the marking line apparatus and the various implements necessary for operating the same. One of said apparatuses consists of a tape applying apparatus A, said apparatus being essentially constructed and operatable as known in the art as referred to above, adapted for spacedly applying, during the travel of the vehicle, segments Ts of prefabricated tape material T, of the multilayer kind as described in the above indicated French Patent Publication No. 77.04466 and German Patent Application P 27 02 442.6 (U.S. Pat. application Ser. No. 758,693, filed on Jan. 12, 1977). A supply of such tape material T is carried by the vehicle in bobbin form, as indicated at B.

Few details of the apparatus A are shown in FIG. 1. This apparatus may comprise tape progressing means including cutting means for forming spaced segments Ts therefrom, said means being for example of the type shown in FIGS. 4 and 5 of the U.S. Pat. No. 3,964,835 of present applicant. It further includes heating means, such as burners H, for applying heat to the tape in a location near to the position at which the leading end portion of each segment contacts the road pavement P, during the step-by-step advancement of the tape.

The preferred embodiment of FIG. 1 comprises also a second apparatus Bp adapted to paint marking line segments Ps on the road pavement P, aligned with said segments Ts of tape, in the intervals between the applied (or to be applied) tape segments. The said apparatus Bp is well known, as individually considered and therefore it will not be described in details.

In the modified embodiment of FIG. 2 the first apparatus A (which might be identical to that of FIG. 1) is associated to a second apparatus Bt of the kind adapted for forming marking line segments by localizedly spraying an essentially liquid (generally hot) substance or composition, adapted to form the marking line segments when quenched or otherwise set. Said apparatus Bt is also known, as individually considered.

The actuator means of said apparatuses A and Bp (or Bt) are phasedly interconnected, by means of suitable phasing means, easily conceivable by those skilled in the art, so that the operation of the machine will provide markings of the type such illustrated, for example, in FIGS. 3 and 4, wherein marking lines of the interrupted or fragmented type are shown (the type which is usually made use of for forming traffic lane dividing lines).

Each marking line, in its entirety, consists of a sequence of tape segments Ts individually of rather short length Tl (one meter, for example) and of painted (or otherwise formed, such as by apparatus Bt of FIG. 2) segments Ps of length (such of two meters) greater than that of the tape segments Ts, and indicated at Pl, and of not marked portions of length generally of the order of the sum of lengths Tl and Pl, for providing the discontinuities along the marking line of the interrupted type.

Said interrupted marking line will be therefore formed by a sequence of aligned recurrent portions each of length Rpl, that is the sum of the lengths Tl and Pl of the tape and respectively of the painted segments, plus that of the not marked portions.

Preferably, a better efficienty is ensured by locating the painted segments Ps "upstream" of the respectively adjacent tape segments Ts, facing the direction D of travel of the motor vehicles on the marked traffic lanes, that is the direction from which the light rays or beams (diagrammatically indicated at L in FIG. 4) impinge on the marking segments.

From what above it is evident that a marking line produced by the new machine comprises costly tape material T in a great deal less amount than that required for conventionally forming a corresponding marking line.

It is further evident that new machine can form the above composite marking line by travelling at the most desirable speed. As a matter of fact, the speed at which a tape material applying machine is limited by the speed required for heat viscosing the material primer lower face. Now, the entire time available for heating the primer composition associated to one tape segment Ts is that occurring to the machine for travelling a length Rpl (FIG. 4) that is from the location at which a tape segment is applied to that of the subsequently applied tape segment.

Surprisingly, a composite marking line as above has an efficiency, from the point of view of its either daytime and nighttime visibility, very near to a marking line including marked parts completely formed by tape segments, provided with corresponding retroreflective elements. This surprising result is diagrammatically indicated in FIG. 4.

Motorists currently experience that a discontinuous or segmented marked lines, such as traffic lane dividing lines, appear essentially continuous that is uninterrupted when seen at relevant distance, such as the distance at which the light rays emitted by the vehicle headlamps can be retroreflected and actually seen. The composite marked line as above is formed, when seen at distance, as a string of closely spaced luminous spots which cannot pratically be distinguished from each other. The tape segments Ts are further in substantial relief relatively to the adjacent parts, which are therefore somewhat shadowed by the tape segments, thus cooperating for the apparent continuity of the composite arrangement of tape and of painted segments.

At shorter distances and in daytime (that is where sharp retroreflection is not critical) each composite marked portion comprising tape and painted segments, appears uniform, that is the marking line appears to be quite conventional.

I claim:

1. A road marking machine, particularly for forming a traffic regulating line, comprising a chassis movable along a road to be marked; first applying means on said chassis operative for applying a plurality of first separate strips onto a road to be marked, so that when said chassis moves along the road the first strips applied onto the road follow one after another, said first applying means being adapted to so apply said first separate strips to the road that each two adjacent first strips applied to the road are spaced one from each other along the movement of the chassis so as to constitute therebetween an elongated gap on the road; and second applying means on said chassis adapted for applying at least one second strip different from said first strips in said gap between said two adjacent first strips so that said second strip is aligned with said first strip along the direction of the movement of the chassis and at least partially covers said gap on the road to thereby constitute together with said first strips a traffic regulating line, said second means being adapted to spray a predetermined substance of said second strip onto the road and into the gap between said first strips.

2. A road marking machine, particularly for forming a traffic regulating line, comprising a chassis movable along a road to be marked; first applying means on said chassis operative for applying a plurality of first separate strips of prefabricated tape material onto a road to be marked, so that when said chassis moves along the road the first strips are applied onto the road follow one another, said first applying means being adapted to so apply said first separate strips to the road that each two adjacent first strips applied to the road are spaced one from the other along the movement of the chassis so as to constitute therebetween an elongated gap on the road; and second applying means on said chassis adapted for applying paint so as to form at least one second strip in said gap between said two adjacent first strips to be aligned with said first strips along the direction of the movement of the chassis and to at least partially cover said gap on the road, to thereby constitute together with said first strips a traffic regulating line composed of the alternating strips of prefabricated tape material and paint.

3. A machine as defined in claim 2, wherein said second applying means are adapted to so apply said paint into said gap on the road that at least a portion of said gap remains uncovered by said one second strip.

4. A machine as defined in claim 2, wherein said second applying means are adapted to apply said paint so that said one second strip has two end portions and at least one end portion thereof is closely adjacent to the corresponding end portion of one of the two adjacent first strips bounding said gap.

5. A machine as defined in claim 2, wherein said first applying means are adapted for applying said first strips consisting of prefabricated multilayer tape of the kind including a lower layer made of a primer layer forming composition adapted to be intimately connected to the road, and for heating said lower layer immediately prior to contact of the same with the road.

6. A machine as defined in claim 5, wherein said first applying means further comprise heating means operative for applying heat to said lower layer of the multilayer tape.

7. A machine as defined in claim 2, wherein said first applying means are adapted to apply a plurality of first strips each having a first predetermined length.

8. A machine as defined in claim 7, wherein said first applying means are adapted to apply a sequence of separate first strips so that said each two adjacent strips are spaced from each other to thereby form a plurality of recurrent sets of two adjacent strips, each of said sets having a second predetermined length.

9. A machine as defined in claim 8, wherein said first predetermined length does not exceed one fifth of said second predetermined length.

10. A machine as defined in claim 9, wherein each of said second strips has a third predetermined length substantially smaller than that of said gap so that the traffic regulating line constituted by said first and second strips appears from a distance to be an uninterrupted line.

11. A method of marking a road, particularly with a traffic regulating line, comprising the steps of applying to a road to be marked a first sequence of first strips following one after another, so that each two adjacent first strips are in alignment with and spaced from each other by an elongated gap; and applying directly to the road a second sequence of second strips different from said first strips and following one after another, so that at least one second strip is applied to the road into said elongated gap between said two adjacent first strips to be aligned with said first strips along the direction which the machine takes along the road and to at least partially cover said gap and to thereby constitute together with said first strips a traffic regulating line, said step of applying said second strip constituting the step of spraying a substance of the second strip onto the road in the gap between said two adjacent first strips.

12. A method as defined in claim 11, and further comprising step of allowing said substance to solidify onto the road so as to form said second strip in the gap between said two adjacent first strips.

13. A method of marking a road, particularly with a traffic regulating line, comprising the steps of applying to a road to be marked a first sequence of first strips constituted of prefabricated tape material and following one after another, so that each two adjacent first strips are in alignment with and spaced from each other by an elongated gap; and applying directly to the road a paint so as to form a second sequence of second strips also following one after another, so that at least one second strip is applied to the road into said elongated gap between said two adjacent first strips to be aligned with said first strips along the direction which the machine takes along the road and to at least partially cover said gap, to thereby constitute together with said first strips a traffic regulating line composed of the alternating strips of prefabricated tape material and paint.

14. A method as defined in claim 13, wherein said paint forming said one second strip is so applied in the gap between said two adjacent first strips as to only partly cover said gap to thereby leave at least a portion of said gap uncovered by said second strip.

* * * * *